US006767230B2

(12) United States Patent
Lai

(10) Patent No.: US 6,767,230 B2
(45) Date of Patent: Jul. 27, 2004

(54) CARD CONNECTOR DEVICE HAVING DAUGHTER BOARD RETAINER

(75) Inventor: Chih Ming Lai, Taipei (TW)

(73) Assignee: Giga-Byte Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 10/327,006

(22) Filed: Dec. 24, 2002

(65) Prior Publication Data

US 2004/0121636 A1 Jun. 24, 2004

(51) Int. Cl.[7] ..... H01R 13/62

(52) U.S. Cl. ..... 439/153; 439/377

(58) Field of Search ..... 439/153, 157, 439/160, 372, 155, 377

(56) References Cited

U.S. PATENT DOCUMENTS

| | | | | |
|---|---|---|---|---|
| 5,302,133 A | * | 4/1994 | Tondreault | 439/157 |
| 6,368,124 B1 | * | 4/2002 | Wang | 439/153 |
| 6,379,168 B1 | * | 4/2002 | Wang | 439/160 |
| 6,425,778 B1 | * | 7/2002 | Haq et al. | 439/377 |
| 6,431,890 B1 | * | 8/2002 | Li et al. | 439/160 |

* cited by examiner

*Primary Examiner*—P. Austin Bradley
*Assistant Examiner*—Felix O. Figueora
(74) *Attorney, Agent, or Firm*—Rosenberg, Klein & Lee

(57) ABSTRACT

A connector device includes a housing mounted on a mother board and having a slot for receiving a daughter board. A retainer is used for securing the daughter board to the housing, and includes a base having a channel for receiving the daughter board, and a seat having a bore for slidably receiving a latch. A spring may bias the latch to engage with the daughter board and to lock the daughter board to the base and the seat of the retainer. The latch includes an end portion having an angled surface for allowing the daughter board to move the latch against the spring.

7 Claims, 4 Drawing Sheets

CARD CONNECTOR DEVICE HAVING DAUGHTER BOARD RETAINER

BACKGROUND OF THE INVENTION

1. Field of the Invention

The present invention relates to a connector device, and more particularly to a card connector device having a retainer for solidly and effectively retaining or latching daughter boards to mother boards.

2. Description of the Prior Art

Typical card connector devices have been provided for securing daughter boards to mother boards. One of the typical card connector devices is disclosed in U.S. Pat. No. 6,368,124 to Wang, and comprises a retention arm having a latch projection for engaging with and for locking the daughter board to a housing of the card connector device.

However, the retention arm is formed integral with the housing with molding processes. When the card connector device is formed or manufactured with a softer material, the retention arm will have no suitable resilience to retain or to latch the daughter board to the housing.

On the contrary, when the card connector device is formed or manufactured with a relatively harder or stronger material, the daughter board may not easily move over or beyond the retention arm, and the retention arm may have a good chance to be broken by the users when the retention arm is bent relative to the housing.

The present invention has arisen to mitigate and/or obviate the afore-described disadvantages of the conventional card connector devices.

SUMMARY OF THE INVENTION

The primary objective of the present invention is to provide a card connector device including a retainer for solidly and effectively retaining or latching daughter boards to mother boards.

In accordance with one aspect of the invention, there is provided a connector device comprising a mother board, an elongate housing mounted on the mother board, and including an elongate slot formed therein, a daughter board selectively engageable into the slot of the housing, and a retainer for securing the daughter board to the housing. The retainer includes a base having a channel formed therein for receiving the daughter board, and a seat having a bore formed therein, and a latch slidably received in the bore of the seat, and means for biasing the latch to engage with the daughter board and to lock the daughter board to the base and the seat of the retainer.

The biasing means includes a spring engaged between the latch and the seat, for biasing the latch to move relative to the seat and to engage with the daughter board.

The latch includes an end portion extendible into the channel of the base, and an angled surface formed in the end portion thereof for engaging with the daughter board when the daughter board is engaged into the channel of the base.

A knob is further provided and secured to the latch for moving the latch relative to the seat against the biasing means, and includes a partition having an aperture formed therein, the latch includes an end portion engaged through the aperture of the partition and secured to the knob.

The aperture of the knob includes a non-circular cross section, and the end portion of the latch includes a non-circular cross section engaged in the aperture of the knob, for preventing the knob from rotating relative to the latch.

The latch includes at least one catch provided on the end portion thereof, and engageable with the knob, for locking the knob to the latch. The latch includes a groove formed in the end portion thereof, and a lock having a bar engaged into the groove of the latch.

The knob includes an orifice formed therein for receiving the lock. The knob includes at least one passage formed therein and communicating with the orifice thereof, the lock includes at least one projection extended therefrom and engageable into the passage of the knob, for securing the lock to the knob.

The knob includes an outer peripheral portion having at least one peripheral swelling provided thereon for facilitating movement of the knob relative to the seat and the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
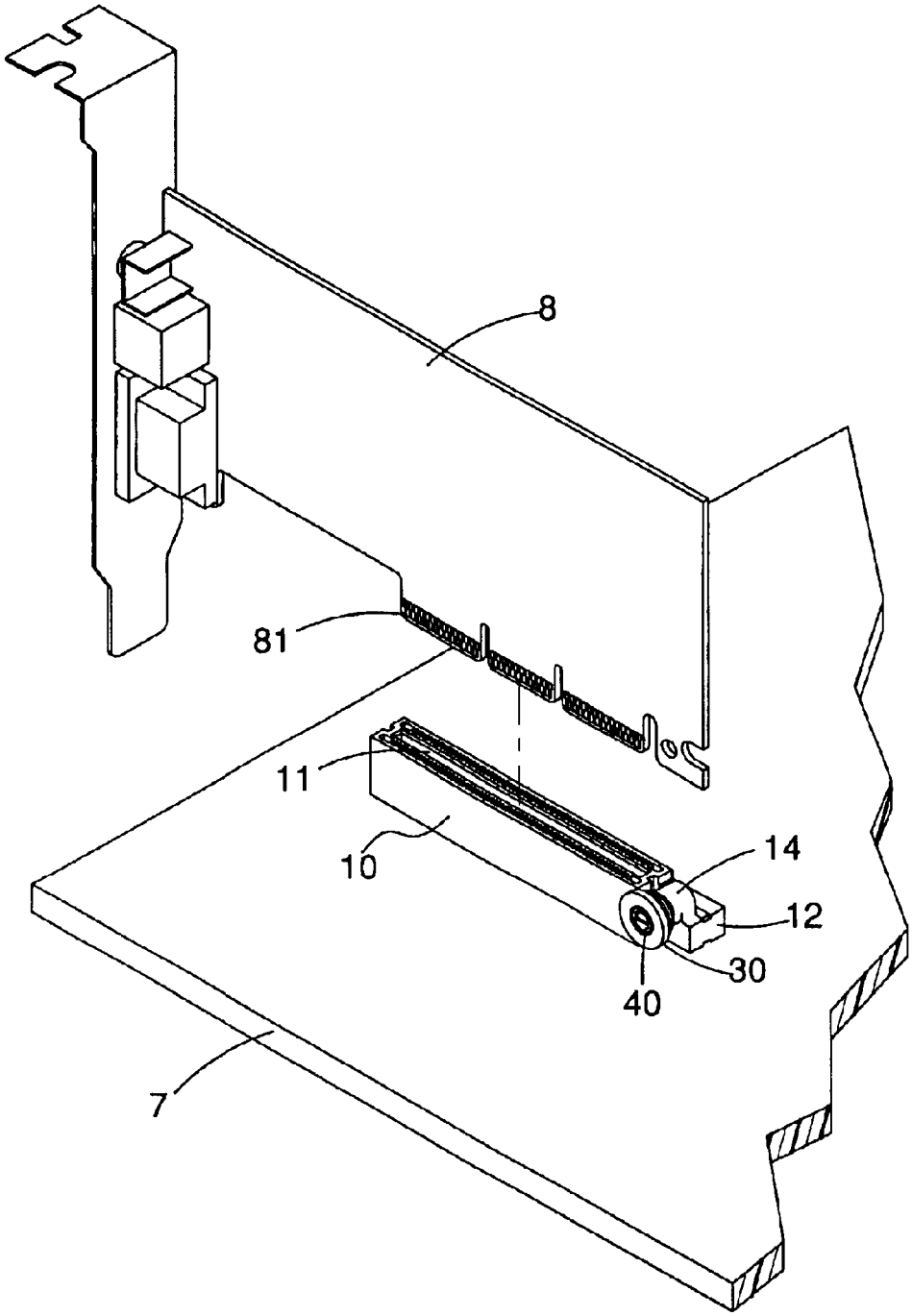
FIG. 1 is a partial exploded view of a card connector device in accordance with the present invention.
Figure 2:
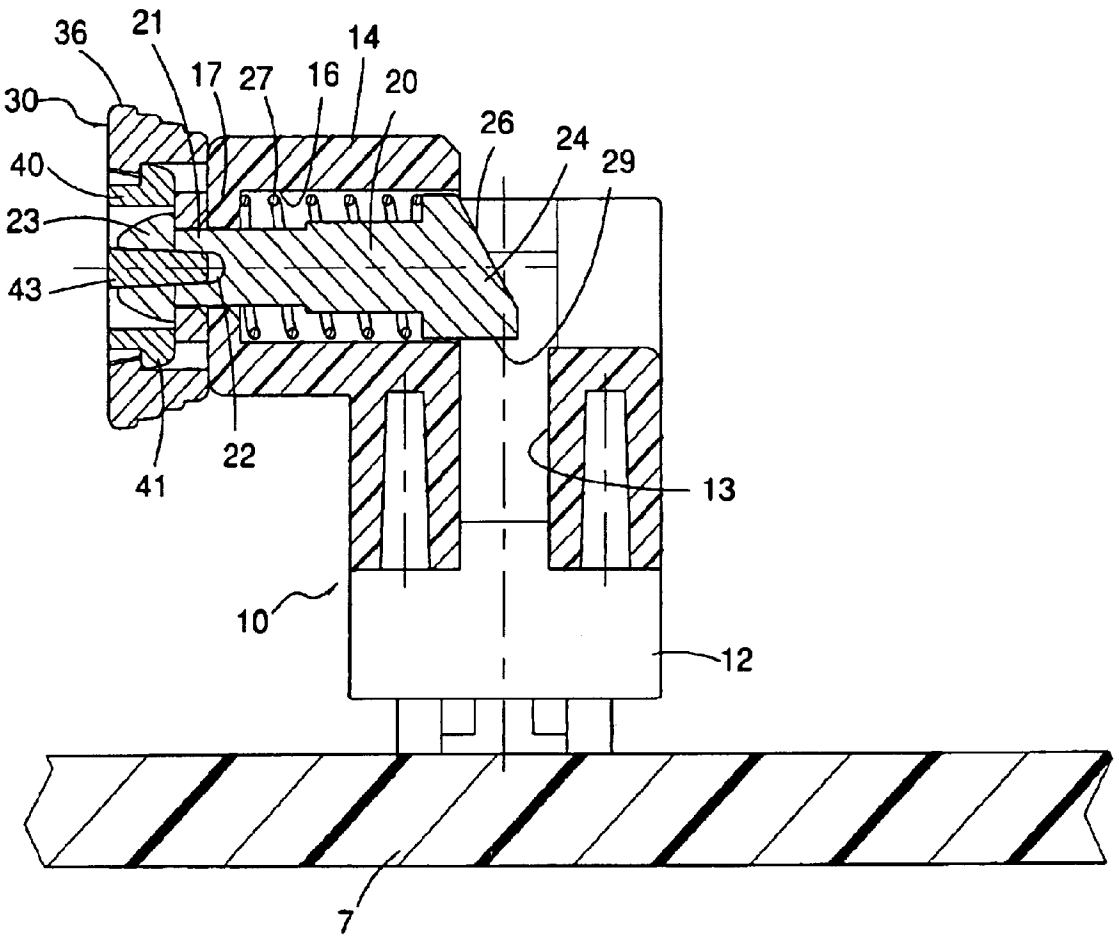
FIG. 2 is a partial cross sectional view taken along lines 2—2 of FIG. 1.
Figure 3:
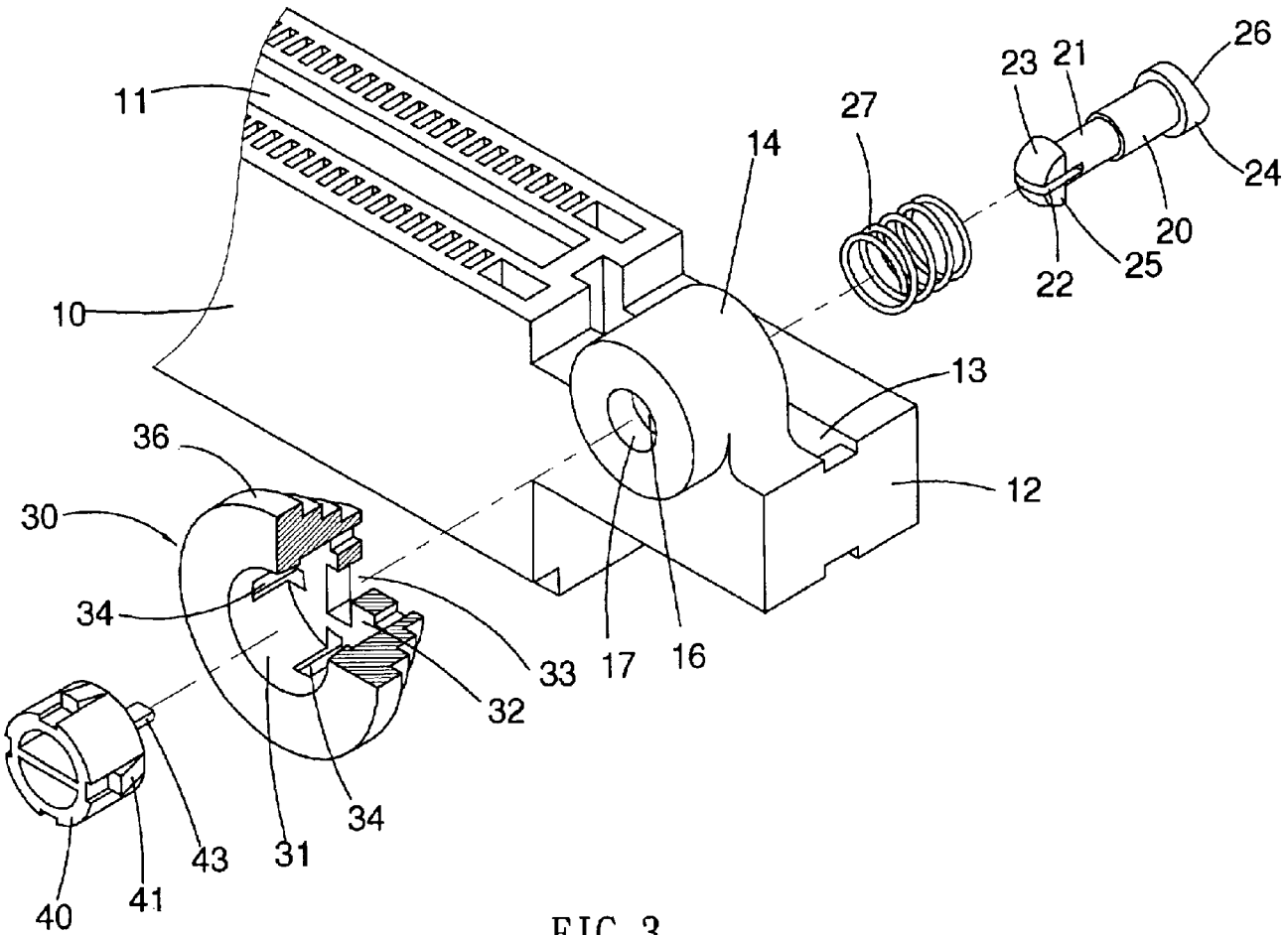
FIG. 3 is a partial exploded view of the card connector device.

Referring to the drawings, and initially to FIGS. 1–3, a card connector device in accordance with the present invention comprises a daughter board 8 to be attached to a mother board 7 with an elongated housing 10 and a retainer 1. For example, the elongated housing 10 is mounted onto the mother board 7 and includes an elongate slot 11 formed therein for receiving the daughter board 8 therein.

The elongated housing 10 includes a number of typical conductive members (not shown) for electrically coupled to the corresponding conductive members 81 of the daughter board 8.

However, the coupling of the conductive members 81 of the daughter board 8 and of the elongated housing 10 is not related to the present invention and will not be described in further details.

The retainer 1 is further provided for retaining or securing the daughter board 8 to the housing 10 and/or to the mother board 7. For example, the retainer 1 may be formed integral or attached or secured to one end of the elongated housing 10, or secured to the mother board 7, and for securing the daughter board 8 to the housing 10 and/or the mother board 7.

Figure 5:
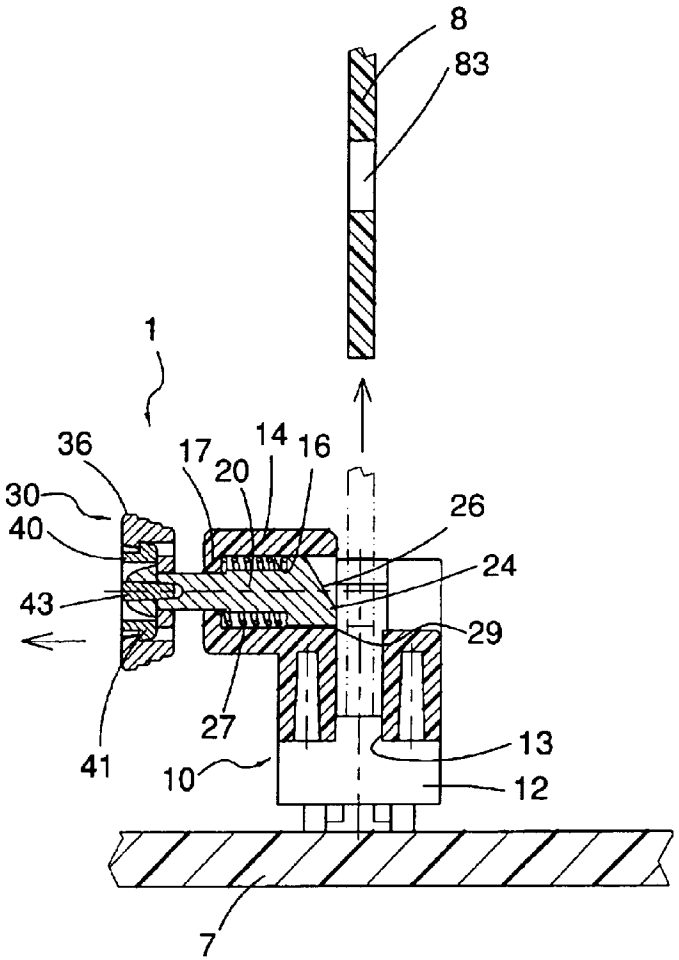
FIGS. 4, 5 are partial cross sectional views similar to FIG. 2, illustrating the operation of the card connector device.
Figure 4:
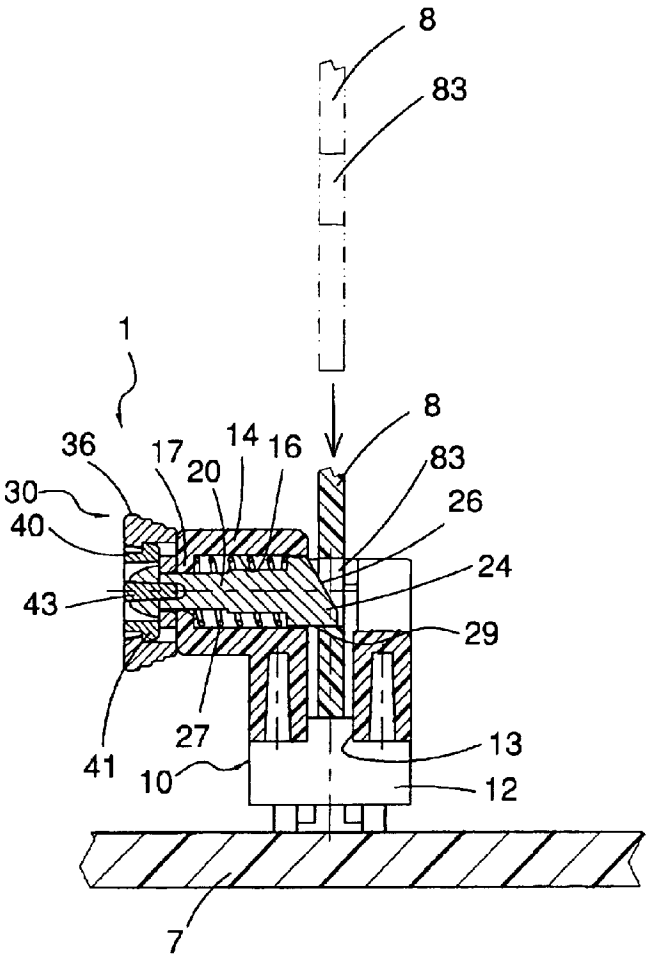

The retainer 1 includes a base 12 either secured to the elongated housing 10 or directly secured to the mother board 7, and having a channel 13 formed therein for receiving a portion or an edge of the daughter board 8 (FIGS. 4, 5). The retainer 1 includes a seat 14 provided or secured on the base 12, and having a bore 16 formed therein, and a peripheral flange 17 extended radially into one end of the bore 16 thereof A latch 20 is slidably received in the bore 16 of the seat 14, and includes one end 21 extendible out of one end of the seat 14, and having a groove 22 formed therein, and having one or more catches 23 formed or provided on the end 21 thereof. The end 21 of the latch 20 or the catches 23 each includes one or more flat surfaces 25 formed therein, or keys (not shown) or the like provided thereon.

The latch 20 includes an enlarged head 24 formed or provided on the other end thereof and having an outer diameter about equal to the inner diameter of the bore 16 of the seat 14, for allowing the head 24 and the latch 20 to be stably and smoothly and slidably received in the bore 16 of the seat 14. A spring 27 is engaged between the latch 20 latch head 24 and the seat 14, for biasing the head 24 of the latch 20 into the channel 13 of the retainer 1.

As best shown in FIGS. 2, 4 and 5, the other end or the head 24 of the latch 20 includes an inclined or angled surface 26 formed therein, and arranged for engaging with the daughter board 8 which may engage with the angled surface 26 of the latch 20 to move the latch 20 into the seat 14 against the spring 27.

For example, as shown in FIG. 4, when the daughter board 8 is engaged into the channel 13 of the retainer 1, the daughter board 8 may engage with the inclined surface 26 of the latch 20, to move the latch 20 into the seat 14 against the spring 27, for allowing the daughter board 8 to be easily engaged into the channel 13 of the retainer 1, and then for allowing the head 24 of the latch 20 to be biased to engage into an opening 83 of the daughter board 8 (FIG. 4).

The latch 20 or the head 24 of the latch 20 may include one or more guiding members or keys or flat surfaces 29 (FIGS. 2, 4, 5) formed therein, for engaging with the cooperative guiding members or keys or flat surfaces of the seat 14 or of the base 12, and for preventing the latch 20 from rotating relative to the seat 14 and the base 12, and for positioning the angled surface 26 of the latch 20 relative to the base 12 of the seat 14, and for engaging with the daughter board 8 when the daughter board 8 is to be engaged into the channel 13 of the retainer 1.

A knob 30 is further provided for moving the latch 20 relative to the seat 14, or against the spring 27, for disengaging the head 24 of the latch 20 from the daughter board 8 (FIG. 5), and for allowing the daughter board 8 to be disengaged from the seat 14 and the base 12 of the retainer 1.

The knob 30 includes an orifice 31 formed therein, and an end wall or a partition 32 having an aperture 33 formed therein for receiving the one end 21 and the catches 23 of the latch 20.

The aperture 33 of the partition 32 may include a non-circular cross section defined by one or more flat surfaces or key holes, for engaging with the corresponding non-circular cross section or flat surfaces 25 of the catches 23 or of the latch 20, for preventing the latch 20 from rotating relative to the knob 30, and for allowing the latch 20 to be rotated by the knob 30.

The knob 30 further includes one or more peripheral bulges or swellings 36 provided on the outer peripheral portion thereof for allowing the knob 30 to be easily grasped by the users, in order to pull or to move the latch 20 against the spring 27. The knob 30 further includes one or more passages 34 formed therein and communicating with the orifice 31 thereof.

A lock 40 is provided for engaging into the orifice 31 of the knob 30, and includes one or more projections 41 extended therefrom for engaging through the passages 34 of the knob 30, and then for engaging with the knob 30, in order to leek or to secure the lock 40 to the knob 30. The lock 40 includes a bar 43 engaged into the groove 22 of the latch 20, for forcing the catches 23 to solidly engage with the knob 30, and thus for further solidly securing the knob 30 to the latch 20.

In operation, as shown in FIGS. 4 and 5, the latch 20 is a separate part from the daughter board 8, and is slidable along a direction perpendicular to the daughter board 8, and may thus be easily moved relative to the seat 14 and the daughter board 8, without worrying about being bent or broken relative to the seat 14, as those of the typical card connector device that disclosed in U.S. Pat. No. 6,368,124 to Wang.

When the daughter board 8 is required to be disengaged from the housing 10, the latch 20 or the head 24 of the latch 20 may be moved and disengaged from the daughter board 8 by pulling the latch 20 with the knob 30 and against the spring 27. The daughter board 8 may thus be easily disengaged from the housing 10 when the latch 20 or the head 24 of the latch 20 is disengaged from the opening 83 of the daughter board 8.

Accordingly, the card connector device in accordance with the present invention includes a retainer having a latch slidably relative to the seat or the housing for solidly and effectively retaining or latching daughter boards to the housing and/or to the mother boards.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A connector device comprising:

a mother board, an elongate housing mounted on said mother board, and including an elongate slot formed therein, a daughter board selectively engageable into said slot of said housing, and a retainer for securing said daughter board to said housing, said retainer including:

a base having a channel formed therein for receiving said daughter board, a seat mounted on said base and having a bore formed therein, a latch slidably received in said bore of said seat and having a first end portion extendible into said channel of said base, said first end portion of said latch having a first side formed with an angled surface for engaging with said daughter board when said daughter board is inserted into said channel of said base, a spring mounted on said latch and urged between a second side of said first end portion of said latch and a wall of said bore of said seat, for biasing said latch to move relative to said seat and to engage with said daughter board, and a knob secured to said latch for moving said latch relative to said seat against said spring, wherein said knob includes a partition having an aperture formed therein, and said latch includes a second end portion extended through said aperture of said partition and secured to said knob.

2. The connector device according to claim 1, wherein said aperture of said knob includes a non-circular cross section, and said second end portion of said latch includes a non-circular cross section engaged in said aperture of said knob, for preventing said knob from rotating relative to said latch.

3. The connector device according to claim 1, wherein said latch includes at least one catch provided on said second end portion thereof, and engageable with said knob, for locking said knob to said latch.

4. The connector device according to claim 1, wherein said latch has a groove formed in said second end portion thereof, and said retainer further includes a lock having a bar engaged into said groove of said latch.

5. The connector device according to claim 4, wherein said latch includes at least one catch provided on said second end portion thereof, and engageable with said knob, said bar forces said at least one catch of said latch to engage with said knob.

6. The connector device according to claim 4, wherein said knob has an orifice formed therein for receiving said lock.

7. The connector device according to claim 6, wherein said knob has at least one passage formed therein and communicating with said orifice thereof, said lock includes at least one projection extended therefrom and engageable into said at least one passage of said knob, for securing said lock to said knob.

* * * * *